US009211550B2

(12) United States Patent
Cutler et al.

(10) Patent No.: US 9,211,550 B2
(45) Date of Patent: Dec. 15, 2015

(54) SHOWER WITH DETACHABLE FACEPLATE

(71) Applicant: KYLIN Sanitary Technology (Xiamen) Co., Ltd., Fujian Province (CN)

(72) Inventors: Kyle William Cutler, Fujian Province (CN); Qingshuang Li, Fujian Province (CN); Mengshi Guo, Fujian Province (CN); Chonggen Chen, Fujian Province (CN)

( * ) Notice: Subject to any disclaimer, the term of this patent is extended or adjusted under 35 U.S.C. 154(b) by 221 days.

(21) Appl. No.: 14/033,438

(22) Filed: Sep. 21, 2013

(65) Prior Publication Data

US 2014/0151466 A1 Jun. 5, 2014

(30) Foreign Application Priority Data

Dec. 4, 2012 (CN) ..... 2012 2 0656833 U

(51) Int. Cl.
*B05B 1/16* (2006.01)
*B05B 1/18* (2006.01)

(52) U.S. Cl.
CPC .. *B05B 1/185* (2013.01); *B05B 1/16* (2013.01)

(58) Field of Classification Search
CPC ..... B05B 1/185; B05B 1/16; B05B 1/18; B05B 1/14; B05B 1/1645
USPC ..... 239/447, 436, 437, 440, 441, 442, 443, 239/600; 4/596, 597, 601
See application file for complete search history.

(56) References Cited

U.S. PATENT DOCUMENTS

| | | | | |
|---|---|---|---|---|
| 4,204,614 | A * | 5/1980 | Reeve | 222/153.14 |
| 5,476,225 | A * | 12/1995 | Chan | 239/449 |
| 8,066,203 | B2 * | 11/2011 | Zhou | 239/443 |
| 8,348,181 | B2 * | 1/2013 | Whitaker et al. | 239/447 |
| 8,430,023 | B2 * | 4/2013 | Hynes | 99/323.1 |
| 8,819,981 | B2 * | 9/2014 | Malik et al. | 42/73 |
| 2014/0054397 | A1 * | 2/2014 | Wu | 239/436 |
| 2014/0319248 | A1 * | 10/2014 | Kinle | 239/443 |

* cited by examiner

*Primary Examiner* — Justin Jonaitis
(74) *Attorney, Agent, or Firm* — Prakash Nama; Global IP Services, PLLC

(57) ABSTRACT

A shower comprising a detachable faceplate, a body having an assembly chamber, a diverter and a back plate mounted in the assembly chamber. Slots are arranged around the periphery of the back plate. Rotating claws engaging with the slots are arranged around the periphery of the face plate. A locking button is arranged on the body to limit the rotation of the faceplate, to avoid the faceplate from dropping off due to free rotation of the faceplate and improper operation by the consumers. The faceplate can be easily detached by pressing the locking button.

7 Claims, 4 Drawing Sheets

SHOWER WITH DETACHABLE FACEPLATE

BACKGROUND OF THE INVENTION

The present invention relates to a shower, and more specifically relates to a shower with a detachable faceplate.

A shower is a kind of equipment mainly installed in the bathroom for shower. Most showers nowadays have fixed faceplates. These showers are inconvenient to use since lots of impurities will be clogged in the showers over time, and these impurities are not able to be cleaned up because the faceplates are not removable. Some showers are improved to include detachable faceplates. However, those detachable faceplates usually require strong forces to install and detach. Therefore, those improved showers are still not very convenient to use. In particular, those who are physically weak cannot apply enough forces to open the faceplates in order to clean up the impurities inside the shower.

BRIEF SUMMARY OF THE INVENTION

This invention is to provide a shower with a detachable faceplate and to solve the problem of inconvenient detachment of an existing faceplate.

To achieve the above objects, the invention includes:

A shower comprising a body, an assembly chamber provided inside the body, a diverter and a back plate mounted in the assembly chamber, and a faceplate which is detachable, characterized in that, slots are arranged around a periphery of the back plate; rotating claws engaging with the slots of the back plate by rotation of the faceplate are arranged around a periphery of the face plate; a locking button is arranged on the body to limit the rotation of the faceplate.

Additionally, the locking button comprises a gear block, a button and reset springs. The gear block is positioned in a gear slot which is in the back plate and the gear block partially protrudes to an outer side a corresponding slot through a first reset spring of the reset springs. One end of the button is fixed to the outer side of the corresponding slot by a second reset spring of the reset springs, and another end of the button protrudes along a button hole provided on one side of the body to form a button surface.

Additionally, a portion of the gear block facing to the corresponding slot has a slant.

Additionally, the button surface has a shape which is complementary to an external surface of the body.

Additionally, quantities of the slots are four; quantities of the rotating claws are also four; and one of the rotating claws is provided with a bevel.

Additionally, the back plate is fixed to the assembly chamber through a screw.

Compared with the existing prior arts, the present invention has the following advantages:

The shower with detachable faceplate according to the present invention limit the rotation of the faceplate by the locking button, thereby preventing the faceplate from falling off due to its free rotation and preventing wrong operation by consumers during use; to detach the faceplate, press the button of the locking button so that the locking button no longer restricts the rotation of the faceplate, and then gently rotate the faceplate to detach it. The subject invention not only allows easy and efficient installation/detachment of the faceplate, but also ensures that the faceplate will not easily fall off after installation. The simple structure and convenient use of the present invention render the present invention suitable for use by the general public.

DETAILED DESCRIPTION OF THE INVENTION

The present invention is further described in detail below with reference to a specific embodiment and the accompanying drawings.

Figure 1:
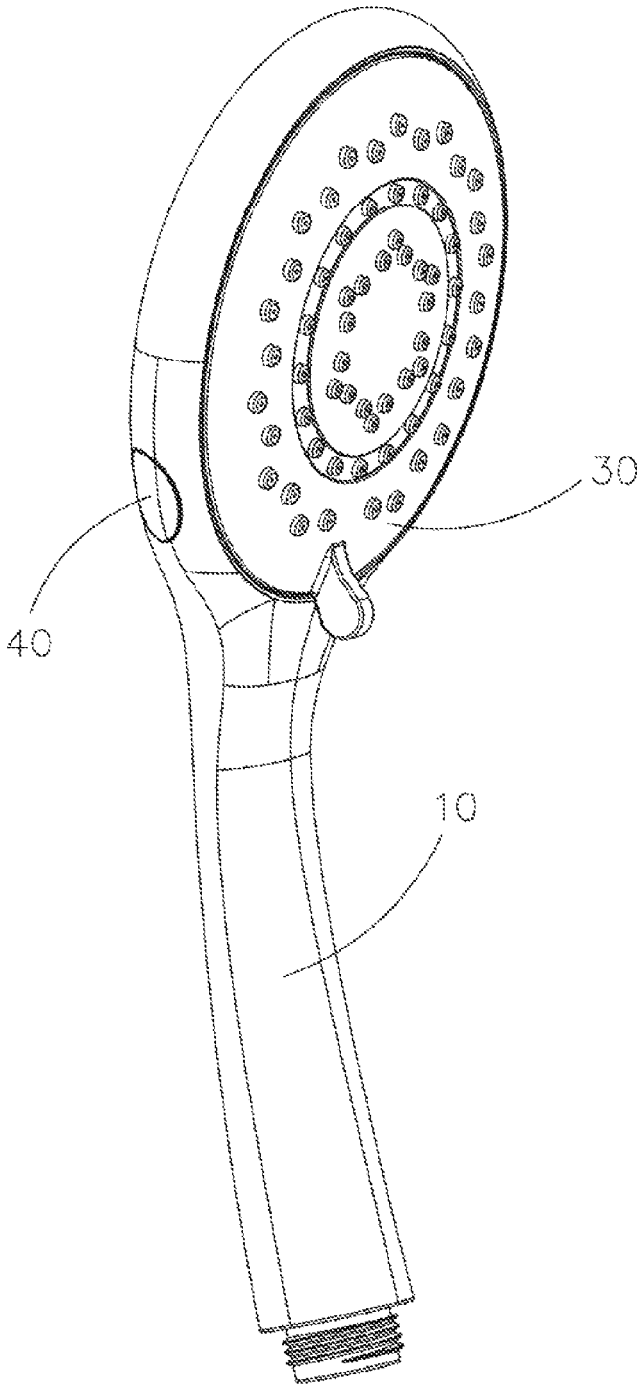
FIG. 1 is a schematic view showing the overall structure of a preferred embodiment of the present invention.
Figure 2:
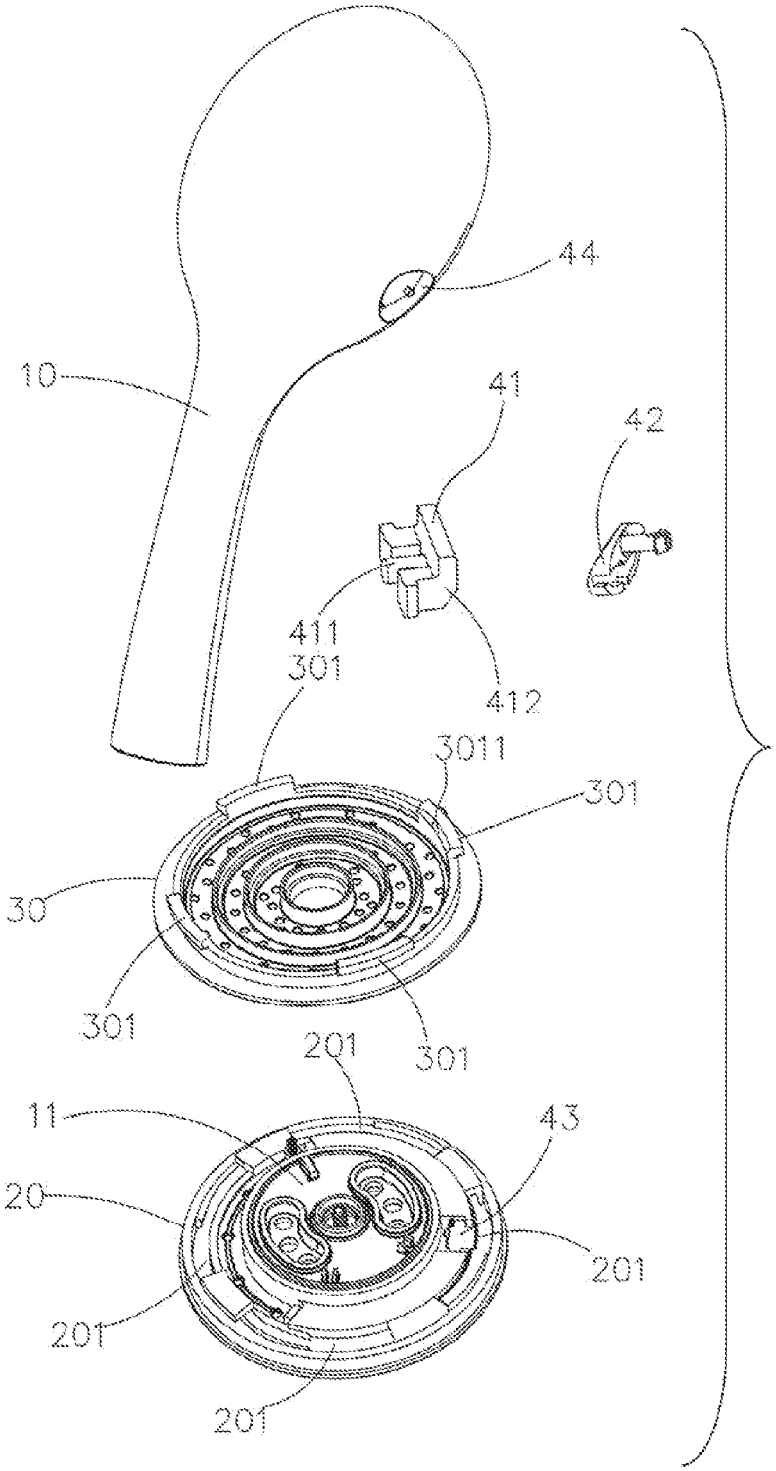
FIG. 2 is an exploded view of a preferred embodiment of this invention.
Figure 3:
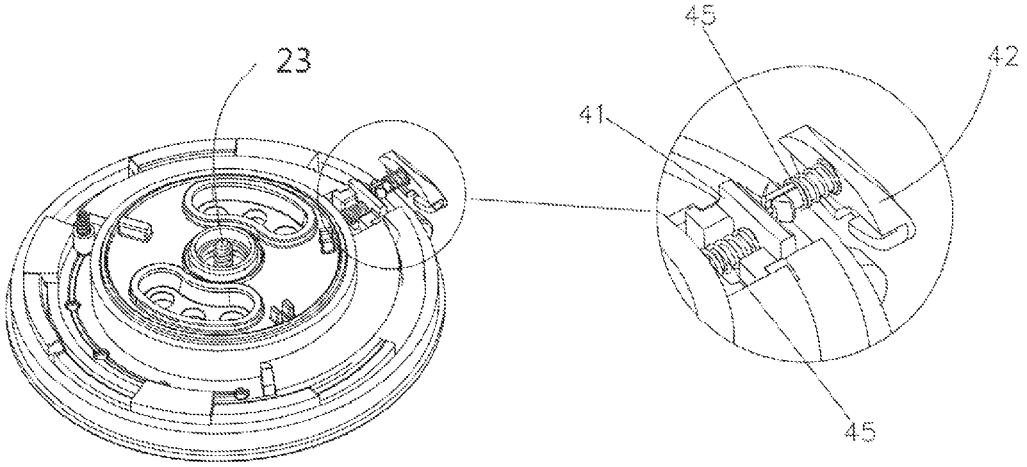
FIG. 3 is a schematic view of a locking structure of this invention.

FIG. 1 is a schematic view showing the overall structure of a preferred embodiment of the present invention; FIG. 2 is an exploded view of a preferred embodiment of this invention; FIG. 3 is a schematic view of a locking structure of this invention. With reference to FIG. 1, FIG. 2 and FIG. 3, a shower comprises a body equipped with an assembly chamber 10, a diverter 11, a back plate 20 and a faceplate 30 which is detachable from the body. The diverter 11 is superposed on the back plate 20, and the diverter 11 together with the back plate 20 are fixed to the assembly chamber 10.

A periphery of the back plate 20 is provided with slots 201; a periphery of the faceplate 30 is provided with rotating claws 301 engaging with the slots 201; the slots 201 and the rotating claws 301 are both plural in terms of their quantities, and each slot corresponds to a corresponding rotating claw; preferably, there are four slots 201 and four corresponding rotating claws 301; one of the rotating claws 301 is provided with a bevel 3011. The bevel 3011 is formed by a plane cut along a front end to a rear end of an inner side of the rotating claw that engages with a corresponding slot.

The body is provided with a locking button 40 to limit rotation of the faceplate 30.

The locking button 40 comprises a gear block 41, a button 42 and a plurality of the reset springs 45; after a pear lever 411 of the gear block 41 fits with a reset spring, the gear block 41 is disposed in a gear slot 43 of the back plate 20; the gear block 41 partially protrudes to an outer side of a corresponding slot due to action force of the reset spring disposed at the gear lever 411.

One end of the button 42 is fixed to the outer side of the corresponding slot by another reset spring, another end of the button 42 protrudes outward along a button hole 44 of the body 10 to form a button surface of the looking button 40. Optionally, undercut rib can be additionally provided to the button 42 to reinforce its fixation with the button hole 44 to prevent the button 42 from falling off from the button hole 44.

The gear block 41 has a slant 412. The slant 412 faces the corresponding slot. When assembling the faceplate 30, the bevel 3011 faces to the slant 412 of the gear block 41 to reduce resistance imposed by the gear block 41 to the corresponding rotating claw having the bevel 3011, thereby reducing the force of closing the faceplate 30 and make the closing easier.

The button surface has a shape that is complementary to the external surface of the body, that is, the button surface has a shape that fits well with the contour of the external surface of the body, thereby maintaining the aesthetic beauty of the shower without interfering with normal use of the shower.

The back plate 20 is fixed to the assembly chamber 10 through a screw 23.

Figure 4A:
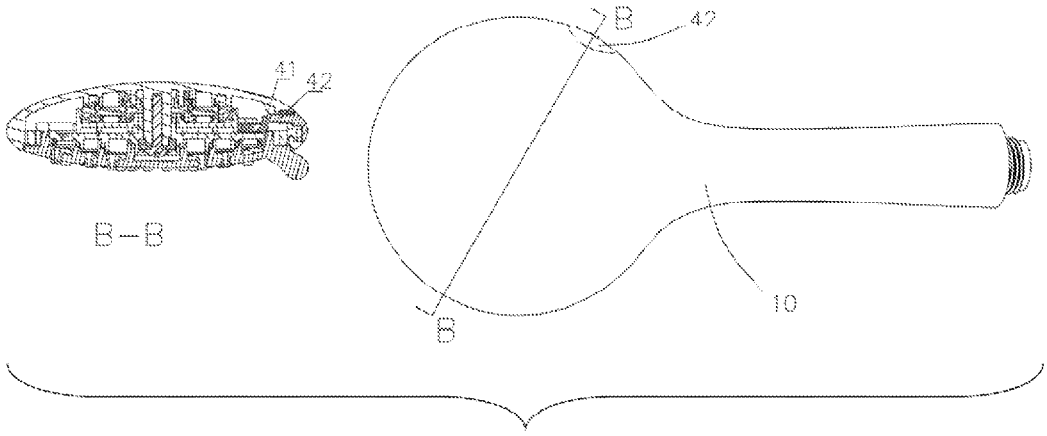
FIG. 4*a* shows a sectional view along B-B of the body, wherein the faceplate is shown to be switched to a releasing end position.
Figure 4B:
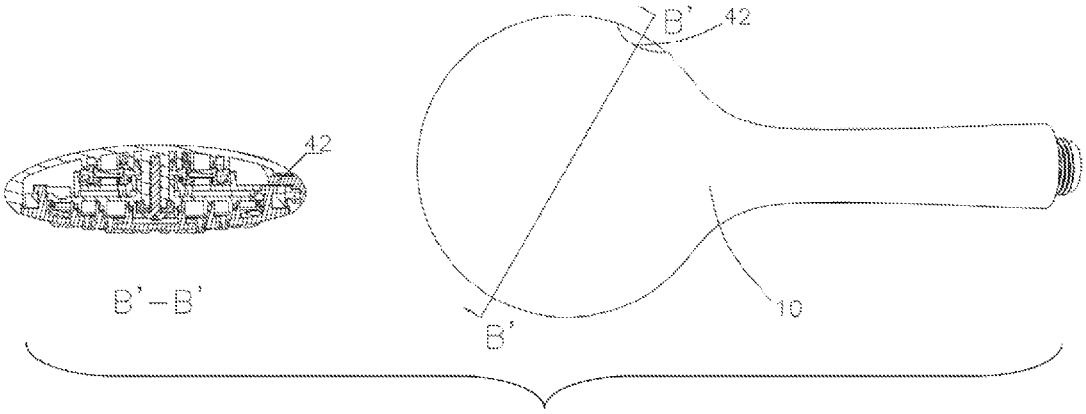
FIG. 4*b* shows a sectional view along B'-B' of the body, wherein the faceplate is shown not being switched to the releasing end position.

Installation and detachment of the faceplate according to the above preferred embodiment are described as follows: To install the faceplate 30, align the rotating claws 301 of the faceplate 30 and the slots 201 of the back plate 20, and then press the faceplate 30 to the back plate 20 where the corresponding rotating claw having the bevel 3011 pushes the slant 412 of the gear block 41 via the bevel 3011 to keep the gear block 41 at an open position; after that, rotate the faceplate 30 to a locking end position, which means rotating the faceplate 30 to drive the back plate 20 to rotate as well until the gear block 41 on the back plate 20 locks against the body, and then continuing rotating the faceplate 30 until the rotating claws 301 on the faceplate 30 tightly engages with the back plate 20. To detach the faceplate 30, rotate the faceplate 30 to a releasing end position, which means rotating the faceplate 30 to drive the back plate 20 to rotate until the back plate 20 is static with respect to the body, then continuing rotating the faceplate 30 until the rotating claw having the bevel 3011 is blocked by the gear block 41, and then pressing the button 42 to push the gear block 41 backward, and after that rotating the faceplate 30 slightly so that the rotating claws 301 align with the slots 201 to exit therefrom; the faceplate 30 can now be detached. FIGS. 4*a* and 4*b* are schematic sectional views showing whether the faceplate is rotated to reach the releasing end position. FIG. 4*a* shows the situation where the faceplate 30 is rotated to the releasing end position where the gear block 41 aligns with the button 42, as shown by section B-B of FIG. 4*a*. FIG. 4*b* shows the situation where the faceplate 30 is not rotated to the releasing end position where the gear block 41 does not align with the button 42, as shown by section B'-B' of FIG. 4*b*. In the situation shown by FIG. 4*b*, the faceplate 30 cannot he opened.

The shower with a detachable faceplate provided by the present invention limits the rotation of the faceplate 30 by the locking button 40, thereby preventing the faceplate 30 from falling off from the shower due to its free rotation and preventing wrong operation by consumers during use; to detach the faceplate, press the button 42 of the locking button 40 so that the locking button no longer restricts the rotation of the faceplate, and then gently rotate the faceplate to detach it. The subject invention not only allows easy and efficient installation/detachment of the faceplate, but also ensures that the faceplate will not easily fall off after installation. The simple structure and convenient use of the present invention render the present invention suitable for use by the general public.

Although the present invention is described above with reference to preferred embodiments, the above description does not intend to limit the present invention. Any person skilled in the art can make possible changes and modifications without deviating from the scope and essence of the present invention.

What is claimed is:

1. A shower comprising a body, an assembly chamber provided inside the body, a diverter and a back plate mounted in the assembly chamber, and a faceplate which is detachable, characterized in that, slots are arranged around a periphery of the back plate; rotating claws engaging with the slots of the back plate by rotation of the faceplate are arranged around a periphery of the face plate; a locking button is arranged on the body to limit the rotation of the faceplate.

2. The shower as in claim 1, wherein the locking button comprises a gear block, a button and reset springs; the gear block is positioned in a gear slot which is in the back plate; the gear block partially protrudes to an outer side of a corresponding slot through a first reset spring of the reset springs; one end of the button is fixed to the outer side of the corresponding slot by a second reset spring of the reset springs, and another end of the button protrudes along a button hole provided on one side of the body to form a button surface.

3. The shower as in claim 2, wherein a portion of the gear block facing to the corresponding slot has a slant.

4. The shower as in claim 2, wherein the button surface has a shape which is complementary to an external surface of the body.

5. The shower as in claim 1, wherein quantities of the slots are four; quantities of the rotating claws are also four; and one of the rotating claws is provided with a bevel.

6. The shower as in claim 2, wherein quantities of the slots are four; quantities of the rotating claws are also four; and one of the rotating claws is provided with a bevel.

7. The shower as in claim 1, wherein the back plate is fixed to the assembly chamber through a screw.

* * * * *